US010309052B2

(12) United States Patent
Villella et al.

(10) Patent No.: US 10,309,052 B2
(45) Date of Patent: Jun. 4, 2019

(54) AIR FLOW PRESSURE COMPENSATOR SYSTEM FOR CLOTHES DRYERS

(71) Applicant: WHIRLPOOL CORPORATION, Benton Harbor, MI (US)

(72) Inventors: Bruce R. Villella, Johnston, RI (US); James Beaudreault, Lincoln, RI (US)

(73) Assignee: Whirlpool Corporation, Benton Harbor, MI (US)

( * ) Notice: Subject to any disclaimer, the term of this patent is extended or adjusted under 35 U.S.C. 154(b) by 519 days.

(21) Appl. No.: 14/906,098

(22) PCT Filed: Jul. 21, 2014

(86) PCT No.: PCT/US2014/047363

§ 371 (c)(1),
(2) Date: Jan. 19, 2016

(87) PCT Pub. No.: WO2015/010115

PCT Pub. Date: Jan. 22, 2015

(65) Prior Publication Data

US 2016/0244907 A1 Aug. 25, 2016

Related U.S. Application Data

(60) Provisional application No. 61/856,259, filed on Jul. 19, 2013.

(51) Int. Cl.

| | |
|---|---|
| ***D06F 58/28*** | (2006.01) |
| ***D06F 58/02*** | (2006.01) |
| ***D06F 58/20*** | (2006.01) |

(52) U.S. Cl.

CPC ..... *D06F 58/28* (2013.01); *D06F 58/02* (2013.01); *D06F 58/20* (2013.01); *D06F 2058/2854* (2013.01); *D06F 2058/2864* (2013.01)

(58) Field of Classification Search

CPC ..... D06F 58/28; D06F 58/02; D06F 58/20; D06F 2058/2864; D06F 2058/2854

See application file for complete search history.

(56) References Cited

U.S. PATENT DOCUMENTS

| | | | |
|---|---|---|---|
| 4,081,997 A | 4/1978 | Losert | |
| 6,725,732 B1 | 4/2004 | Stein | |

(Continued)

FOREIGN PATENT DOCUMENTS

| | | | |
|---|---|---|---|
| DE | 102008049034 A1 * | 4/2010 | ..... D06F 58/28 |
| EP | 1775368 A1 | 4/2007 | |

(Continued)

OTHER PUBLICATIONS

European Search Report for Counterpart EP14826584.6, dated Nov. 23, 2016.

(Continued)

*Primary Examiner* — Jessica Yuen
(74) *Attorney, Agent, or Firm* — Mcgarry Bair PC

(57) ABSTRACT

An air flow pressure compensator system maintains substantially constants air flow within a clothes dryer system and adjusts the speed of one or more exhaust fans by monitoring one or more sensors/transmitters positioned in one or more exhaust ducts and/or one or more incoming air ducts. The system includes a compensator controller; a variable frequency drive electrically coupled to the compensator controller; and an anemometer and/or a differential pressure sensor/transmitter electrically coupled to the compensator controller that allow for real-time monitoring and system adjusting, which improve clothing drying time and dryer efficiency.

14 Claims, 8 Drawing Sheets

(56) References Cited

U.S. PATENT DOCUMENTS

| | | | | |
|---|---|---|---|---|
| 6,745,495 | B1 | 6/2004 | Riddle et al. | |
| 6,829,522 | B1 | 12/2004 | Filev et al. | |
| 7,870,799 | B2 | 1/2011 | Neumann | |
| 2003/0030408 | A1 | 2/2003 | Ratz et al. | |
| 2010/0045472 | A1 | 2/2010 | Siddall | |
| 2010/0256821 | A1 | 10/2010 | Jeung et al. | |
| 2011/0290043 | A1* | 12/2011 | Lehman | G01M 99/002 73/865.6 |

FOREIGN PATENT DOCUMENTS

| | | | |
|---|---|---|---|
| EP | 2072910 | A2 | 6/2009 |
| WO | 2008058211 | A2 | 5/2008 |

OTHER PUBLICATIONS

International Search Report and Written Opinion for Counterpart PCT/US2014/047363, dated Nov. 3, 2014.

* cited by examiner

AIR FLOW PRESSURE COMPENSATOR SYSTEM FOR CLOTHES DRYERS

CROSS-REFERENCE TO RELATED APPLICATIONS

This application claims priority to International Application No. PCT/US2014/047363, filed Jul. 21, 2014, which claims priority to U.S. Application Ser. No. 61/856,259, filed Jul. 19, 2013, the entirety of which is incorporated herein by reference.

BACKGROUND OF THE INVENTION

The present disclosure relates to air flow pressure compensator systems incorporated into clothes dryers to increase air flow and improve clothes drying efficiency.

Multiple factors affect the drying efficiency of clothes dryers and particularly how air flows through a dryer. These factors include, but are not limited to, the positioning and arrangement of exhaust ducting and the blockage of air exiting the tumbler.

When a clothes dryer system is installed, exhaust ducting is coupled to the system and then positioned and arranged to a vent the dryer to the outside. However, frequently during installation, exhaust ducting is particularly lengthy due to the long distance between the outer dryer vent and outside venting. Depending on where the installation is placed, exhaust ducting may also be arranged to have a large number of twists and turns in order reach outside venting. What results from arranging exhaust ducting in this manner is a ducting environment that affects the overall efficiency of the clothes dryer. For example, high static pressure will likely develop within in the exhaust ducting, reducing air flow in system and extending drying times for clothes.

Also, as a cycle of a clothes dryer progresses, the removal of moisture from clothing causes clothes to impede air flow in the system. As clothes dry, the nature of clothing materials change. Some materials tend to fan or spread out and block air from exiting the tumbler. This reduces air flow through the clothing material and also negatively affects drying times.

For these reasons, among others, there is a clear need for air flow pressure compensator systems incorporated into clothes dryers to increase air flow and improve clothes drying efficiency. The present invention fulfills this need and provides further related advantages, as described below.

BRIEF SUMMARY OF THE INVENTION

Disclosed herein is an air flow pressure compensator system used to maintain substantially constants air flow within a clothes dryer system. Specifically, the compensator system adjusts the speed of one or more exhaust fans by monitoring one or more sensors/transmitters positioned in one or more exhaust ducts and/or one or more incoming air ducts. Real-time monitoring of the sensors/transmitters allow for system adjustments which improve clothing drying time and dryer efficiency. These adjustments, therefore, compensate for inefficiencies in the clothes dryer and enhance overall dryer performance.

A more complete understanding of the air flow pressure compensator system will be afforded to those skilled in the art, as well as a realization of additional advantages and objects thereof, by consideration of the following detailed description. Reference will be made to the appended sheets of the drawings, which will first be described briefly.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
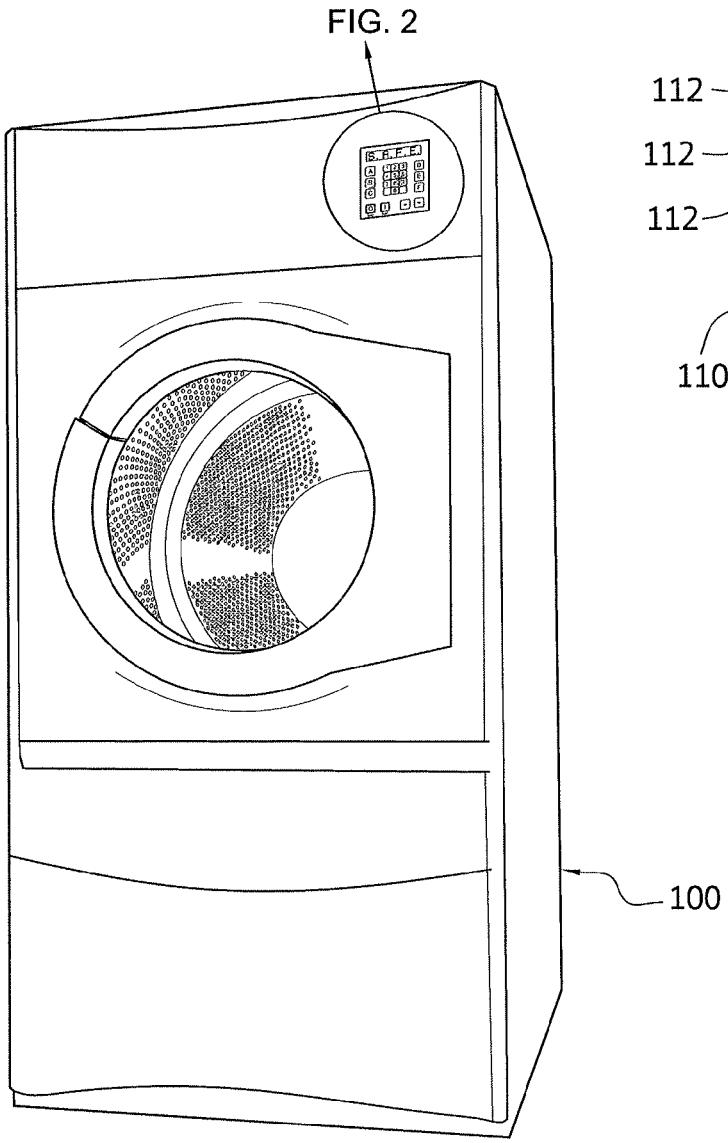
FIG. 1 shows a perspective view of an exemplary dryer that incorporates an air flow pressure compensator system.
Figure 5:
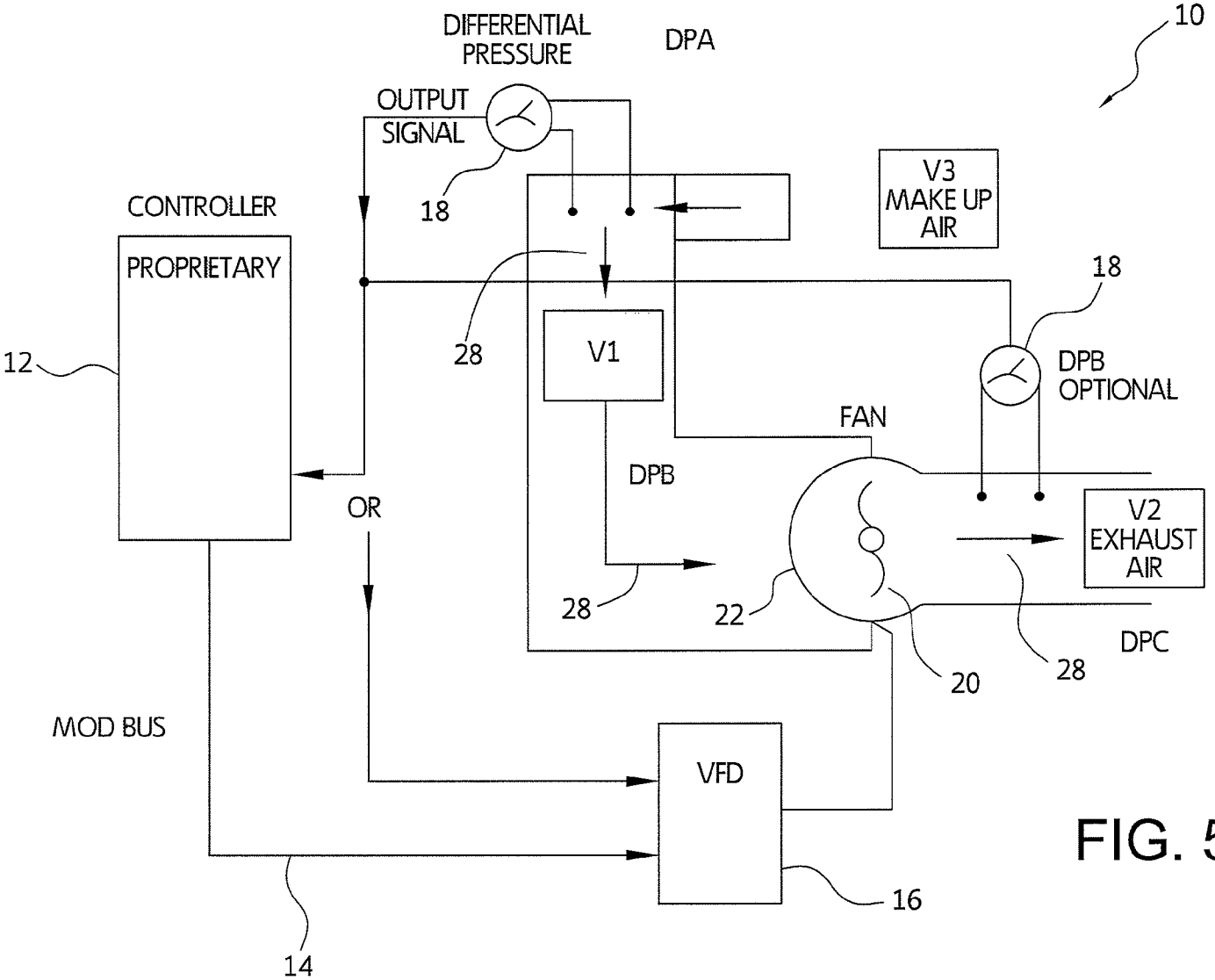
FIG. 5 shows a schematic showing an air flow pressure compensator system.
Figure 6:
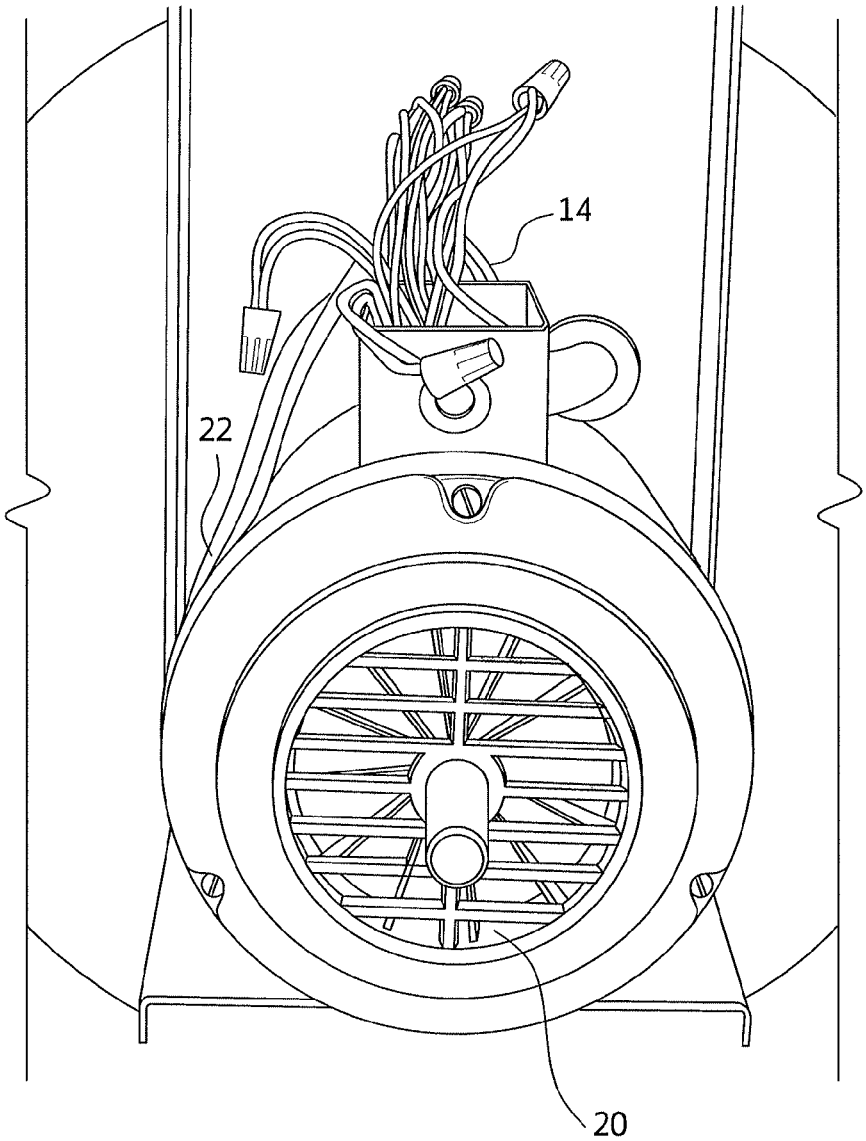
FIG. 6 shows an exemplary exhaust fan incorporated into an air flow pressure compensator system.
Figure 7:
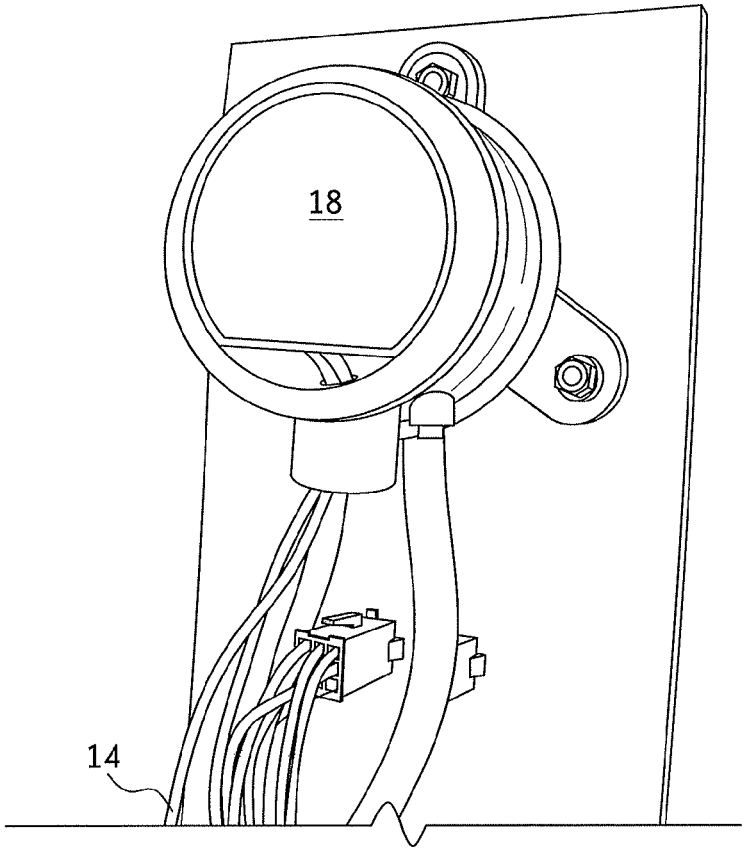
FIG. 7 shows a rear elevated view of an exemplary sensor/transmitter for monitoring pressure and air velocity in an air flow pressure compensator system.
Figure 8A:
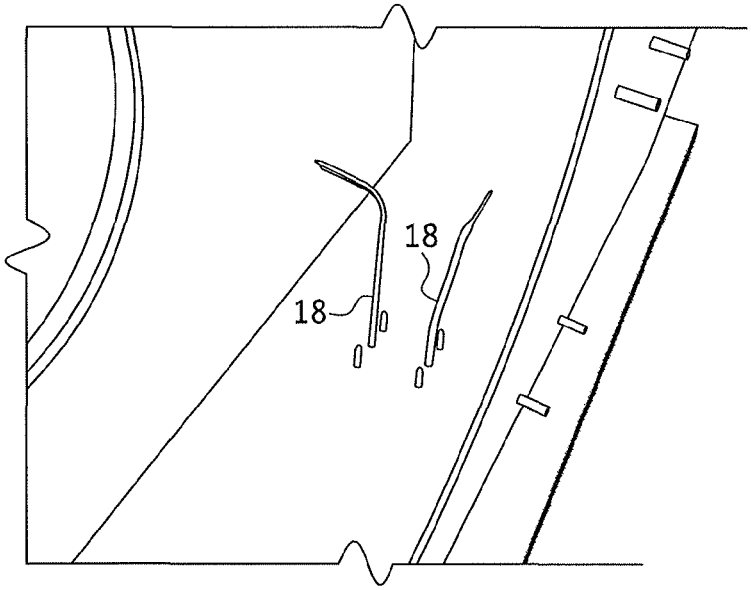
FIGS. 8A and 8B show perspective views of exemplary sensors/transmitters used in an air flow pressure compensator system.
Figure 8B:
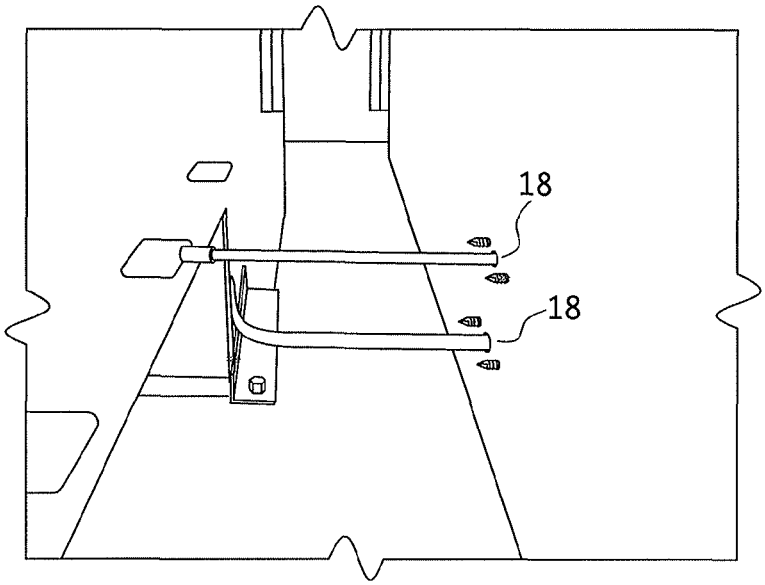

Turning in detail to the drawings, FIG. 1 shows one embodiment of a clothes dryer 100 that incorporates an air flow pressure compensator system 10 (FIG. 5). Clothes dryers that incorporate the air flow compensator systems disclosed herein include those manufactured by American Dryer Corporation (ADC) and particularly air flow compensator systems included in ADC Intelligent Dryer Series (id-series) Dryer Models. The id-series of dryer models is manufactured to achieve higher performance, improved efficiency, shorter clothes dry times, safe and reliable operation, among other benefits.

Figure 2:
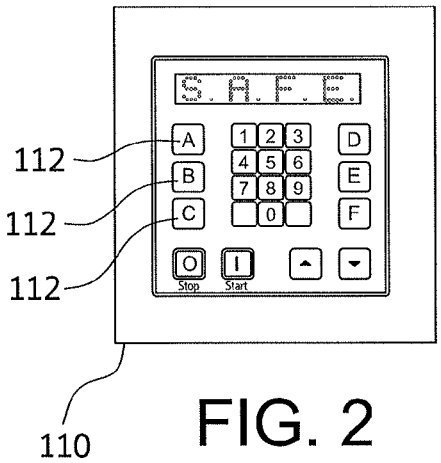
FIG. 2 show a front elevated view of an exemplary controller panel used to operate the air flow pressure compensator system and other dryer controls.

As shown in FIGS. 1 and 2, a clothes dryer 100 includes a control panel 110, having dryer controllers 112 that are electrically coupled to various sub-systems, one of which is the air flow pressure compensator system 10 (FIG. 5). The air flow pressure compensator system 10 is coupled to the control panel 110 by a compensator controller 12, as shown in FIG. 5. The controllers 112 and the control panel 110 are designed to be user-friendly, self-diagnostic, and programmable.

Figure 3:
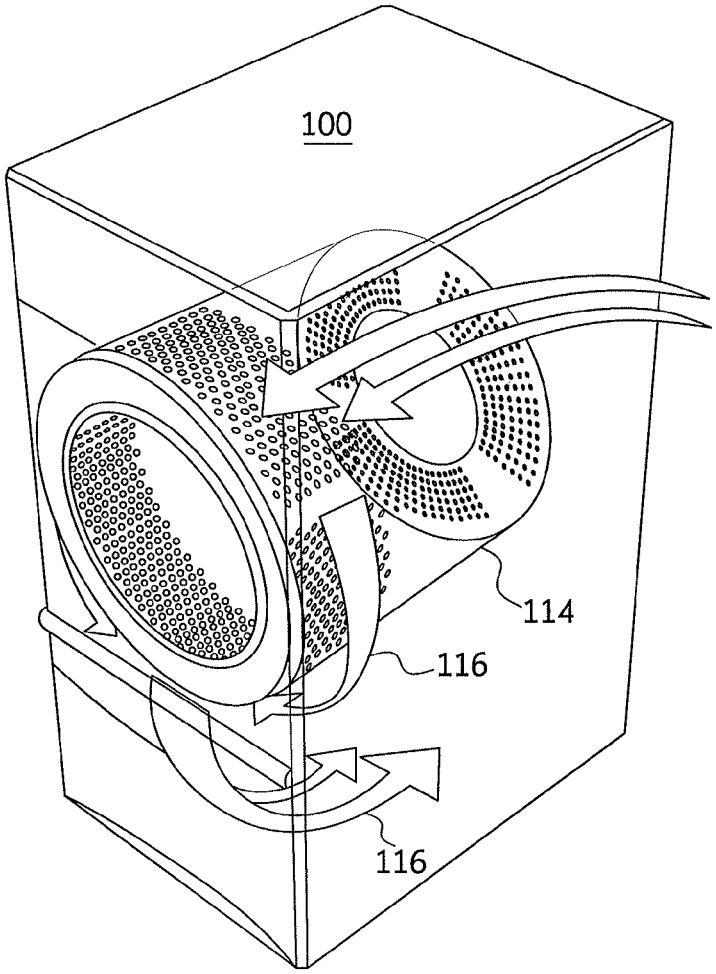
FIG. 3 shows perspective view of a first schematic of air flow in a clothes dryer system.
Figure 4:
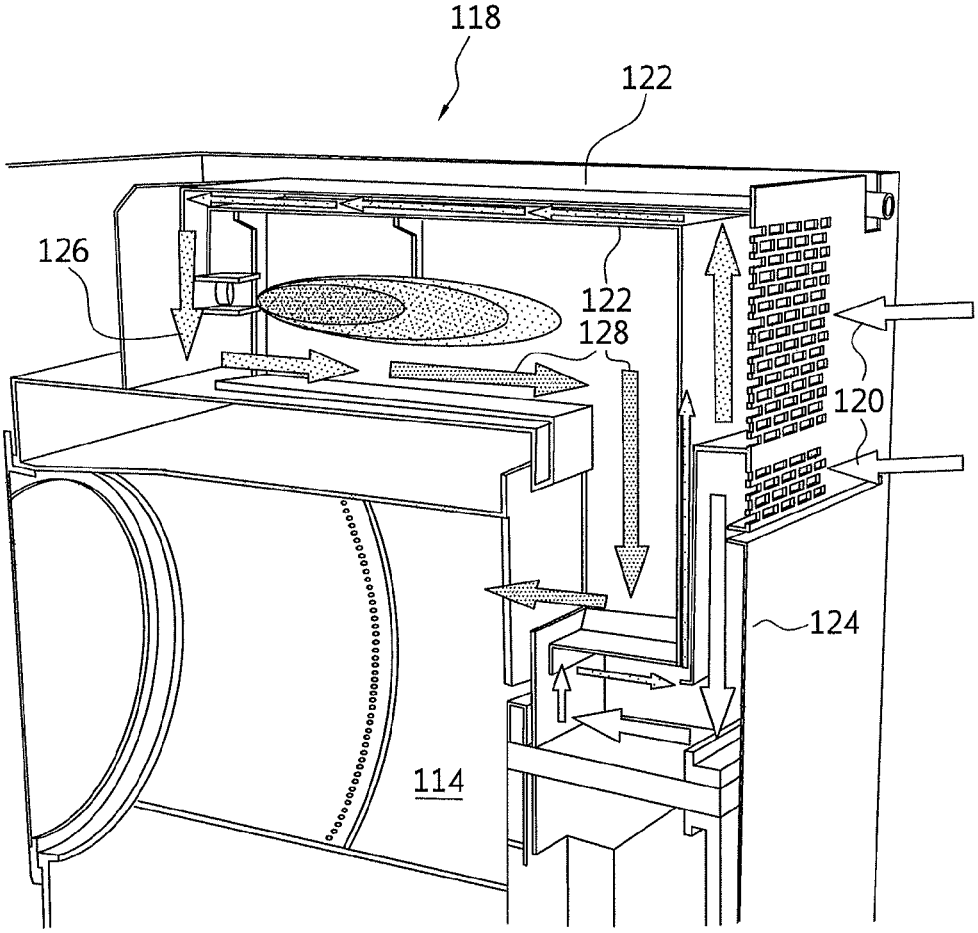
FIG. 4 shows perspective view of a second schematic of air flow in a clothes dryer system.

The id-series dryer models sold by American Dryer Corporation also incorporate features that complement the air flow pressure compensator system 10. As illustrated particularly in FIG. 3, these features include a tumbler 114, which allows trans-axial air flow 116 in the dryer 100 and, as shown in FIG. 4, a unique two-shell design of the id-series burner 118, which forces incoming air 120 (indicated by arrows) in a first pass to sides 122 of an oven housing 124 to pre-heat incoming air 120 and thereafter introduce warmed and heated air into the tumbler (warmed air indicated by arrows 126 and heated air indicated by arrows 128). Each of these features improves dryer efficiency.

Another feature incorporated into the id-series is ADC's patented SENSOR ACTIVATED FIRE EXTINGUISHING (S.A.F.E)™ system, as described in U.S. Pat. Nos. 5,197,203, 6,505,418, and 6,725,570, which are incorporated herein by reference. Some models, which incorporate the air flow pressure compensator systems, include the id35, id50, id80, id120, id30x2, and id45x2 models. Other dryers and dryer systems, however, may incorporate the air flow pressure compensator systems disclosed herein.

FIG. 5 schematically shows one embodiment of an air flow pressure compensator system 10. The system 10 includes a compensator controller 12, circuitry 14, a variable frequency drive 16 (VFD), an anemometer or a differential pressure sensor/transmitter 18, and at least one exhaust fan 20 incorporated into a fan housing 22. The variable frequency drive 16 is incorporated into the system 10 to control motor speed of the dryer blower based on inputs received from one or more differential pressure sensors/transmitters 18. The variable frequency drive 16 is programmed to control the running frequency of the blower motor. One type of drive suitable for use in the system has the following specifications: 0.33-200 hp (0.25 kW-132 kW); 115V/208-240V/380-480V/575V/690V.

Figure 9:
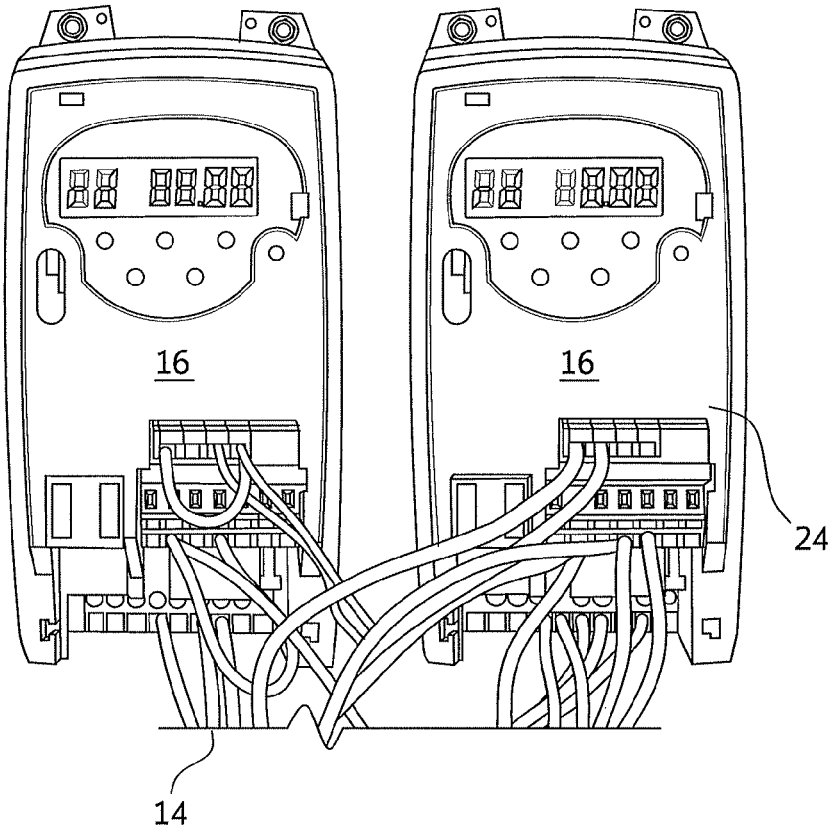
FIG. 9 shows front elevated views of exemplary circuitry and variable frequency drives used in an air flow pressure compensator system.

Programming controls 24 (FIG. 9) may be located on the variable frequency drive 16 or incorporated elsewhere within the system. In one alternative embodiment, the drive can be programmed by a microcontroller (not shown) on a system board, where programming code resides on the microcontroller. In this alternative embodiment, program code can be downloaded to the variable frequency drive.

Referring back to FIG. 5, an exhaust fan 20 is coupled to the variable frequency drive 16 and one or more anemometers or differential pressure sensor/transmitters 18 such that pressure differentials DPA, DPB, DPC and air velocities V1, V2, V3 can be monitored at various points in the system 10. Suitable measurement points within the system 10 for air flow velocity include points for make-up air (V3), exhaust air (V2), and clothing/lint build up points (V1), i.e. where clothing is positioned in a tumbler or where lint build ups.

The anemometers or differential pressure sensor/transmitters 18 are used in the system 10 to measure pressure and convert the pressure to an electrical signal (I.E. 0-10 volt, 4-20 ma, serial data, and/or another means of transferring a measured output). Output signals 26 are then interpreted by the compensator controller 12 and/or the variable frequency drive (VFD) to increase or decrease fan speed such that substantially constant airflow is maintained during dryer operation. As airflow is impeded, as indicated by measurements taken at V1, V2 and/or V3, fan speed will be increased or decreased to maintain substantially constant airflow. Airflow velocity will generally range from 0 to 1 inch water column.

Suitable sensors/transmitters for use in the system include MAGNESENSE® Differential Pressure Transmitters sold by Dwyer Instruments Inc. In a preferred configuration, specifications for the variable frequency drive include the following:

Accuracy: ±1% for 0.25" (50 Pa), 0.5" (100 Pa), 2" (500 Pa), 5" (1250 Pa), 10" (2 kPa), 15" (3 kPa), 25" (5 kPa) 12% for 0.1" (25 Pa), 1" (250 Pa) and all bidirectional ranges.

Stability: ±1% F.S./year.

Temperature Limits: 0 to 150° F. (−18 to 66° C.).

Pressure Limits: 1 psi maximum, operation; 10 psi, burst.

Power Requirements: 10 to 35 VDC (2-wire); 17 to 36 VDC or isolated 21.6 to 33 VAC (3-wire).

Output Signals: 4 to 20 mA (2-wire); 0 to 5 V, 0 to 10 V (3-wire).

Response Time: Field adjustable 0.5 to 15 sec. time constant. Provides a 95% response time of 1.5 to 45 seconds.

Zero & Span Adjustments: Digital push button.

Loop Resistance: Current output: 0-1250Ω max; Voltage output: min. load resistance 1 kΩ.

Current Consumption: 40 mA max.

Electrical Connections: 4-20 mA, 2-wire: European Style Terminal Block for 16 to 26 AWG. 0-10 V, 3-wire: European Style Terminal Block 16 to 22 AWG.

Electrical Entry: ½" NPS Thread. Accessory: Cable Gland for 5 to 10 mm diameter cable.

Process Connection: 3/16" (5 mm) ID tubing. Maximum Outer diameter 9 mm.

Enclosure Rating: NEMA 4X (IP66).

The sensors/transmitters may be connected directly to the variable frequency drive or connected directly to a microcontroller. When a sensor is connected directly to the variable frequency drive, a control decision point is made in the variable frequency drive. When a sensor/transmitter is connected directly to the microcontroller, the control decision point is made in the controller. Decision points are determined by the differential pressure sensor in conjunction with the variable speed drive (VFD). As the sensor detects changes in pressure between 0 and 1 in of WC (Water Column), one or more sensors/transmitters will output a signal between 4 and 20 ma, where 4 ma corresponds to 0 inches WC and 20 ma corresponds to 1 in WC. The variable frequency drive then will use the 4 to 20 ma signal from the sensors/transmitters to change the frequency of the motor and either increase or decrease the fan speed, thereby increasing or decreasing airflow. The variable frequency drive uses a percentage of the 4 to 20 MA, where 4 ma is 0% and 20 ma is 100% to make the adjustment(s).

An alternative method of adjusting fan speed without sensors is to monitor fan motor current. As static pressure increases, fan motor current decreases as the fan pushes less air. Conversely, as static pressure decreases, fan motor current increases as the fan pushes more air.

Using the variable frequency drive to control the fan motor and using fan motor current, particularly symmetrical fan motor current limits function of the variable frequency drive such that one can control the speed of the fan by (1) setting a maximum symmetrical current to a desired percentage of maximum fan motor current, where the maximum symmetrical current will allow the fan motor to run at its maximum current based on a predetermined percentage parameter. Setting a thermal protection parameter to "on" and presetting the variable frequency drive to a maximum desired frequency. When using this control method, as the static pressure increases and the current begin to drop, the variable frequency drive increases the frequency to the motor, and thereby increase motor fan speed until the maximum predetermined percentage parameter has been, thus stabilizing the fan speed.

Conversely, as the static pressure decreases and the motor current begins to rise, the variable frequency drive decreases motor frequency, thereby slowing motor fan speed until the frequency is lowered such that motor current is below a maximum symmetrical current percentage of the motor current. This method also provides a real time fan response, which corresponds to different levels of static pressure.

Examples

The following examples were performed on an ADC Intelligent Dryer Model id120 to assess dryer performance at varying exhaust fan frequencies. Static pressures were set to either 0.6" w.c. or 1.5" w.c. @ 60 Hz while the dryer was empty.

ADC id120 Performance Testing at Varying Fan Frequencies

| | Test # | | | | | | | |
|---|---|---|---|---|---|---|---|---|
| | 1 | 2 | 3 | 4 | 5 | 6 | 7 | 8 |
| Fan Frequency | 40 Hz | 45 Hz | 50 Hz | 60 Hz | 70 Hz | 50 Hz | 60 Hz | 70 Hz |
| Empty Static Pressure | 0.6" w.c. | 0.6" w.c. | 0.6" w.c. | 0.6" w.c. | 0.6" w.c. | 1.5" w.c. | 1.5" w.c. | 1.5" w.c. |
| Load Size (in Lbs) | 120 | 120 | 120 | 120 | 120 | 120 | 120 | 120 |
| Fan Motor Speed (in RPM's) | 1200 | 1350 | 1500 | 1800 | 2100 | 1500 | 1800 | 2100 |
| Fan Motor Volts (VAC) | 117 | 139 | 165 | 212 | 230 | 162 | 221 | 230 |
| Fan Motor Start Amps | 1.7 | 1.92 | 2.18 | 2.74 | 3.68 | 2.11 | 2.74 | 3.53 |
| Fan Motor End Amps | N/A | 1.73 | 1.98 | N/A | 3.25 | 1.91 | 2.43 | 3.08 |
| CFM @ .6" Static & 60 Hz Empty | 738 | 1053 | 1251 | 1600 | 1800 | 1251 | 1600 | 1800 |

The disclosure has been illustrated by detailed description and examples of particular embodiments. Various changes in form and detail may be made to the illustrative embodiments without departing from the spirit and scope of the present invention. It will be appreciated by those skilled in the art that changes could be made to the embodiments described above without departing from the broad inventive concept thereof. It is understood, therefore, that the present invention is not limited to the particular embodiments disclosed, but it is intended to cover modifications within the spirit and scope of the present invention as defined by the appended claims.

The invention claimed is:

1. An air flow pressure compensator system for a clothes dryer, comprising:

an air flow pressure compensator controller;

a variable frequency drive electrically coupled to the air flow pressure compensator controller and adapted to control a motor speed of a motor of a dryer blower of the clothes dryer; and at least one anemometer electrically, adapted to monitor air velocity and provide an output signal based thereon, coupled to the air flow pressure compensator controller and wherein the at least one anemometer is located within the air flow pressure compensator system at one of a make-up air point, an exhaust air point, a clothing build-up point, or a lint build-up point or a differential pressure sensor, adapted to monitor air pressure differentials between different points in an incoming air duct or an exhaust air duct, electrically coupled to the air flow pressure compensator controller;

wherein the air flow pressure compensator controller is configured to interpret the output signal from the at least one anemometer or the differential pressure sensor and control the variable frequency drive based on at least one of the monitored air velocity or the monitored pressure differentials to control the motor speed of the dryer blower to maintain substantially constant air flow of the air in the clothes dryer.

2. The air flow pressure compensator system of claim 1, wherein the motor speed is controlled based on inputs received from multiple differential pressure sensors.

3. The air flow pressure compensator system of claim 2, wherein the at least one anemometer comprises a plurality of anemometers electrically coupled to the air flow pressure compensator and wherein the motor speed is further controlled based on inputs received from the plurality of anemometers.

4. The air flow pressure compensator system of claim 1, further comprising circuitry that electrically couples the air flow pressure compensator controller, the variable frequency drive, and the at least one anemometer or the differential pressure sensor.

5. The air flow pressure compensator system of claim 1, wherein the variable frequency drive is configured to control a running frequency of the motor.

6. The air flow pressure compensator system of claim 1, further comprising programming controls incorporated into the air flow pressure compensator system.

7. The air flow pressure compensator system of claim 6, wherein the programming controls are located on the variable frequency drive.

8. The air flow pressure compensator system of claim 1, further comprising an exhaust fan coupled to the variable frequency drive.

9. The air flow pressure compensator system of claim 8, wherein the exhaust fan is coupled to the at least one anemometer or the differential pressure sensor.

10. The air flow pressure compensator system of claim 1 wherein the at least one anemometer comprises a plurality of anemometers electrically coupled to the air flow pressure compensator and wherein the motor speed is controlled based on inputs received from the plurality of anemometers.

11. The air flow pressure compensator system of claim 10 wherein the plurality of anemometers includes a first anemometer for monitoring air velocity at a make-up air point, a second anemometer for monitoring air velocity at an exhaust air point, and a third anemometer for measuring air at a lint build-up point.

12. The air flow pressure compensator system of claim 1, further comprising circuitry that electrically couples the air flow pressure compensator controller, the variable frequency drive, and the anemometer and the at least one differential pressure sensor.

13. A clothes dryer, comprising:

a dryer control panel coupled to a dryer controller;

a tumbler configured to house clothing materials;

a dryer blower coupled to the dryer control panel; and the air flow pressure compensator system, as claimed in claim 1.

14. A method of maintaining substantially constant air flow within a clothes dryer or clothes dryer system, comprising:

providing the air flow pressure compensator system, as claimed in claim 1;

adjusting a speed of one or more exhaust fans; and monitoring one or more sensors positioned in at least one of one or more exhaust ducts or one or more incoming air ducts.

* * * * *